United States Patent [19]

Uchiyama et al.

[11] Patent Number: 4,565,763

[45] Date of Patent: Jan. 21, 1986

[54] PROCESS FOR PRODUCING TONER

[75] Inventors: Masaki Uchiyama, Tokyo; Yasuo Mitsuhashi, Yokohama, both of Japan

[73] Assignee: Canon Kabushiki Kaisha, Tokyo, Japan

[21] Appl. No.: 498,293

[22] Filed: May 26, 1983

[30] Foreign Application Priority Data

Jun. 2, 1982 [JP] Japan ..... 57-94496

[51] Int. Cl.[4] ..... G03G 11/00

[52] U.S. Cl. ..... 430/109; 430/137

[58] Field of Search ..... 430/137, 109; 528/503

[56] References Cited

U.S. PATENT DOCUMENTS 4,027,080 5/1977 Amtmann et al. ..... 528/503 X 4,217,406 8/1980 Tanaka et al. ..... 528/503 X

*Primary Examiner*—John L. Goodrow

*Attorney, Agent, or Firm*—Fitzpatrick, Cella, Harper & Scinto

[57] ABSTRACT

A process for producing a toner includes melt-blending at least a colorant and a polymer and finely pulverizing the resulting blend after cooling, wherein the polymer is a crosslinked resin having a ratio of weight-average molecular weight to number-average molecular weight (Mw/Mn) exceeding 4.0 and a melt index of 0.01–10 g/10 min. at 110° C. under a load of 10 Kg and the polymer is further crosslinked to form gel during the melt-blending. The toner thus obtained exhibits a good fixability without offset phenomenon over a wide temperature range.

22 Claims, No Drawings

PROCESS FOR PRODUCING TONER

BACKGROUND OF THE INVENTION

1. Field of the Invention

This invention relates to a process for producing a toner to be used for developing electrostatic images in electrophotography, electrostatic recording, electrostatic printing, and the like. More particularly, this invention relates to a process for producing a toner which is suited for hot-roller fixing.

2. Description of the Prior Art

As described in U.S. Pat. Nos. 2,297,691, 3,666,363, and 4,071,361 and in other documents, various electrophotographic processes have so far been known. Electrophotographic processes, however, generally comprise forming an electrostatic latent image on a photosensitive member by a suitable method, developing the latent image with a toner, and if necessary, transferring the toner image onto an image receiving member such as paper or the like, followed by fixing the transferred image with heat, pressure, or a solvent vapor, to obtain a duplicate of the latent image.

As regards the last step of the above process, i.e. the step of fixing a toner image on paper or the like, various techniques and devices have been developed. The most common technique thereof practiced today is the hot press method by a heated roller. In this hot press method, a toner image is fixed by passing the toner-image-bearing sheet over a heated roller, the surface of which has a good toner-releasing property, so that the toner-image-bearing surface will contact the roller surface under pressure. Since the toner image is brought into contact with the heated roller surface under pressure, this method is excellent in heat efficiency and permits quick fixing, thus being applicable very effectively to high-speed electrophotographic copying machines.

According to this method, however, because of the contact of the toner in a molten state with a heated roller surface under pressure, a so-called offset phenomenon is liable to occur, that is, the toner image often partially adheres or transfers to the heated roller surface and the adhered toner in turn transfers to the incoming fixing medium, e.g. the toner image-bearing paper subsequently subjected to fixing, thus staining it. It is therefore one of the essential requirements for the hot roller fixing technique to prevent the toner from adhering to the heated fixing roller surface.

This offset is apt to occur particularly when a low molecular weight resin is used in the toner as the binder resin. It is conceivable in consequence that the offset phenomenon is possibly prevented by using a crosslinked resin. However, investigations by the present inventors revealed that the use of a simply crosslinked resin does not always give a good result. In particular, with an increase in the degree of crosslinking, the required fixing temperature rises and in the case of magnetic toner the anti-offset property becomes inferior.

Practice has been made with a view to prevent the toner from adhering to the fixing roller surface; for instance, the roller surface is coated with a material excellent in toner-releasing property, such as a silicone rubber or fluoroplastic and this coating is further covered with a thin film of liquid, such as a silicone oil, excellent in releasing property, so as to prevent the offset phenomenon and the deterioration of the coating. Although very effective in preventing the offset phenomenon, this practice has problems such that the offset-preventing liquid evaporates off upon heating and smells unpleasant for the operators and that the fixation apparatus is complicated because of a device for supplying the offset-preventing liquid. Accordingly, a desirable approach to the prevention of the offset phenomenon is not to supply such a releasing liquid but to develop a toner which is fixable over a wide temperature range and excellent in anti-offset property.

While it is a matter of course that the toner is required to be good in not only fixability but also the anti-blocking property, developing ability, transferability, cleanability, etc. The existing toners have one or more drawbacks like the following. Many toners fusible at relatively low temperatures tend to cake or agglomerate during storage or standing in a copying machine. Most toners become worse in triboelectric property and flow property with the variation of environmental humidity. At repeated and continuous image development, most toners, carriers and photoconductor surfaces usually deteriorate due to the mutual collision and adhesion. This results in variation of developed image density and increased background optical density, thus degrading image quality. Moreover, if amounts of most toners adhering to the latent-image-bearing photosensitive member surface are increased for the purpose of increasing developed image density, the background optical density usually increases, that is, the so-called fogging occurs. Such being the case, a toner is desired which is excellent in those various properties as well as suitable for fixation with a hot roller.

SUMMARY OF THE INVENTION

The primary object of this invention is to provide a process for producing a toner surmounting the above stated drawbacks and having superior physical and chemical properties.

Another object of this invention is to provide a process for producing a toner which is successfully fixable with a hot roller and in particular is good in anti-offset property.

Still another object of this invention is to provide a process for producing a toner which is suited for fixing with a hot roller and exhibits a good and stable chargeability throughout operating time, giving clear, fog-free images.

Another object of this invention is to provide a process for producing a toner which is suited for hot-roller fixing, superior in flowability and in impact resistance, and which does not agglomerate.

Another object of this invention is to provide a process for producing a toner which is suited for hot-roller fixing and leaves the least amount of staining substance on the toner-carrying member surface or on the latent-image-bearing photoconductor surface.

Another object of this invention is to provide a process for producing a magnetic toner which is suited for hot-roller fixing and serves as a magnetic developer exhibiting adequate magnetism uniformly distributed in all its particles.

With these and other objects in view, the invention consists of a process for producing a toner by melt-blending at least a colorant and a polymer and finely pulverizing the resulting mixture after cooling, characterized in that the polymer is a crosslinked resin having a ratio of weight-average molecular weight to number-average molecular weight (Mw/Mn) exceeding 4.0 and a melt index of 0.01–10 g/10 min. at 110° C. under a load of 10 Kg and the polymer is further crosslinked during the melt-blending.

The toner for hot-roller fixing produced according to the process of the present invention is superior in physical and chemical properties. By using this toner, good hot-roller fixing can be accomplished without causing the offset phenomenon even when no offset-preventing liquid is applied on the fixing roller surface, whereby fixing devices employed can be made more simple and lightweight. Moreover, since the toner has stable and excellent developing ability, the stability and reliability of copying machines employed can be markedly improved.

DESCRIPTION OF THE PREFERRED EMBODIMENT

The present inventors have found that a toner exhibiting a good fixability over a wide temperature range without accompanying offset can be obtained by using, as a binder resin for toners fixable with a hot roller, a gel-containing polymer, in which the soluble portion has a Mw/Mn exceeding 4.0 and which has a melt index of 0.01–10 g/10 min., in particular 0.1–6 g/10 min., at 110° C. under a load of 10 Kg, and further crosslinking the polymer to form gel. It has also been found that, when the gel content in the melt-blended polymer exceeds 50% by weight, the crosslinking is excessive, the softening point of the polymer becomes markedly high, and the preparation of a toner therefore becomes difficult. Accordingly, the gel content in the melt-blended crosslinked polymer is desired to be not exceeding 50% by weight. In particular, when the gel content is less than 35% by weight, the toner can be fixed at nearly the same temperature as that comprising an uncrosslinked polymer of the same type, and very favorable results are obtained.

A crosslinked polymer having the characteristics mentioned above is superior in mechanical properties at a normal temperature, particularly in impact resistance and in toughness, and is not liable to adhere to the surface of the toner-carrying member or the photosensitive member, thereby markedly reducing the deterioration of the toner and the photosensitive member.

Among crosslinked polymers obtained by melt-blending, those having a glass transistion temperature of 50° C. or higher are excellent in avoiding trouble such as agglomeration of the toner in the development device or adhesion of the toner onto the surface of the photosensitive member. Particularly preferred polymers have a glass transition temperature of 50°–80° C. The glass transition temperatures of polymers can be determined with ease by means of a differential scanning calorimeter.

The soluble portion of the polymer used in this invention has a value of Mw/Mn exceeding 4.0, preferably exceeding 10, and particularly a weight-average molecular weight of 100,000 or more. A polymer having a desired melt viscosity can be readily prepared under mild conditions by reacting the above defined polymer with a crosslinking agent. With the resulting polymer, a toner having the desired fixability can be produced steadily.

In a process for producing a toner of this invention, since a thermal crosslinking reaction of the polymer proceeds slowly, the crosslinking reaction is easy to control and a toner having a desired melt-viscosity can be obtained with ease.

In a preferred embodiment of this invention, toner components such as a dye or pigment and a charge-controlling agent are dispersed in the polymer before the cross-linking reaction practically begins at the melt blending. Accordingly, the dispersion in this case is more uniform than that in the highly crosslinked polymer. Thereafter, the polymer is crosslinked to a desired gel content by a mild reaction with a thermal crosslinking agent. The toner thus produced has stable electric properties such as resistivity, as well as stable chargeability, and markedly improved development characteristics since components such as a dye or pigment, magnetic powder, and charge controlling agent are homogenously dispersed in the toner.

As will be illustrated later, when a polymer of $Mw/Mn < 4.0$ and $Mw < 100{,}000$ is used, the amount of crosslinking agent and reaction conditions shall be decided so that the crosslinking reaction may occur more vigorously than when a polymer of $Mw/Mn \geqq 4.0$ is used, in order to obtain a toner of desired fixability by crosslinking. Under such conditions, it is very difficult to stop the reaction in its optimum stage to provide a satisfactory anti-offset property to the resulting toner; it is practically impossible to produce steadily a toner of desired fixability with good reproducibility.

On the other hand, when a polymer of $Mw/Mn > 4.0$ and $Mw > 100{,}000$ is used, a toner having a good anti-offset property can be obtained by crosslinking the polymer to a moderate extent under mild conditions to form gel. Thus, the reaction can be easily controlled and a toner superior in fixability can be produced steadily. Moreover, the polymer of $Mw/Mn > 4.0$ and $Mw > 100{,}000$, when crosslinked moderately, will have a further broader molecular weight distribution, permitting the resulting toner to have a good anti-offset property, with the lowest fixing temperature being maintained at a low level.

Important properties that the toner for electrophotography purposes should possess include triboelectric chargeability as well as the above development and fixing performance characteristics and mechanical properties. For improvement of the chargeability, a charge controlling agent is generally added to the toner. If such additives including a charge controlling agent are not dispersed uniformly in the toner, its triboelectric chargeability will be decreased remarkably, making it difficult to obtain a clear image.

Accordingly, for the purpose of dispersing uniformly the additives including a charge controlling agent, colorant, etc. in the polymer used, raw materials are generally melt-blended at a temperature around the softening point of the polymer, where it exhibits a high melt viscosity. The melt-blending in such a high melt viscosity region results in a uniform dispersion of the additives in the polymer by the action of effective shearing stress due to a high internal friction of the polymer, thus giving a toner having a desired uniform color and chargeability.

However, when such a polymer of $Mw/Mn > 4.0$ and $Mw > 100{,}000$ is melt-blended in the high melt viscosity region around its softening point, the internal friction of the polymer is exceedingly high and hence the shearing stress is too great, thus causing molecular chain scission, leading to the reduction of the melt viscosity, and adversely affecting the anti-offset property. For example, when a slightly crosslinked polymer having a melt index of about 8 g/10 min. is melt-blended on a roll mill at a temperature (about 120° C.) slightly lower than its softening point (about 135° C.) as measured by the ball and ring method, its melt index remarkably increases, to nearly double, whereby the offset-free temperature range of the resulting toner becomes much narrower than that of a toner prepared by melt-blending at temperatures (about 180° C.) considerably higher than the softening point.

The present inventors have found that the problem of the anti-offset property relating to the dispersion of additives can be solved by further crosslinking somewhat a slightly crosslinked polymer when it is melt-blended, thereby compensating for the reduction of the viscosity due to the molecular chain scission.

According to this method, since the melt-blending is carried out in a high melt viscosity region around the softening point of the polymer, the additives are dispersed very uniformly in the polymer, the chargeability is stabilized, and a wider range of offset-free temperature is obtained.

Polymers having a Mw/Mn ratio exceeding 4.0 and a Mw of at least 100,000 can be synthesized by well-known polymerization processes such as solution polymerization, suspension polymerization, emulsion polymerization, and bulk polymerization processes. Methods for controlling the Mw/Mn ratio include: mixing together a plurality of resins different in molecular weight in the form of solution or melt; varying the reaction temperature in the course of the polymerization; conducting the polymerization by proper use of an initiator and chain transfer agent; and suitably increasing the Mw/Mn ratio and Mw by crosslinking a polymer in some degree during its polymerization. Of these methods, the control of Mw/Mn by slight crosslinking is the most suitable in this invention; the crosslinking is carried out, for instance, by adding a minute amount of a polyfunctional monomer to the polymerization system.

The above type of polymer is best synthesized by solution polymerization. The reason is that the emulsion polymerization or suspension polymerization is carried out with a monomer emulsified or dispersed in water, which is the continuous phase, in the presence of an additive such as a surfactant or dispersion stabilizer and then the product polymer is recovered by adding a salt, so that the polymer obtained contains the above hydrophilic additives; toners containing such hydrophilic additives will adsorb moisture under high humidity conditions; this often adversly affects electric properties of toners, e.g. results in the reduction of the resistivity. Bulk polymerization becomes difficult to control with increasing polymerization degree on account of the gel effect.

On the other hand, in solution polymerization, because it is carried out generally in an organic hydrophobic solvent, no hydrophilic additive is necessary and the control of polymerization is relatively easy owing to the presence of the solvent. However, when the crosslinking degree is raised, solvent-insoluble gels are formed, and this makes difficult the reaction control and the polymer recovery after polymerization. It is therefore desirable, to synthesize a polymer by the solution polymerization process while controlling the crosslinking degree within the range where no difficulty as noted above is involved; and to crosslink further the resulting slightly crosslinked polymer during preparation of a toner therefrom, until the polymer has such a melt viscosity as to give a toner of desired fixability. The polymer thus prepared by solution polymerization having excellent properties can be applied more easily to a toner suited for hot-roller fixing.

The melt index in this invention was measured by using an apparatus as described in JIS K-7210 (test method for flow of thermoplastics) with manual cutting of the discharged polymer strand.

The Mw/Mn ratio was calculated from the data obtained by gel permeation chromatography. The gel permeation chromatography was conducted at 25° C. by passing 0.5 ml of a 8 mg/ml solution of the specimen in tetrahydrofuran and eluting with tetrahydrofuran at a flow rate of 1 ml/min. For the purpose of measuring accurately molecular weights ranging from $1\times10^3$ to $2\times10^6$, it is desirable to combine a plurality of commercial polystyrene columns; for example, a combination of $\mu$-Styragels 500, $10^3$, $10^4$, and $10^5$ supplied by Waters Co. and a combination of Shodexes A-802, 803, 804, and 805 supplied by Showa Denko Co., Ltd. are advisable. The molecular weight of the specimen is calculated from the elution curve referring to the calibration curve showing the dependence of the logarithm of the molecular weight on the count number (elution volume) prepared from several standard monodispersed polystyrenes of different molecular weight. Standard polystyrene samples suitable for the preparation of calibration curves are, for example, those of molecular weights $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ supplied by Pressure Chemical Co. or Toyo Soda Manufacturing Co., Ltd. It may be desirable to use at least 10 standard polystyrene samples of different molecular weights. A refractive index detector may be suitable for the detection of the polymer.

The gel content of a polymer is the crosslinked, solvent-insoluble fraction (% by weight) of the polymer, namely an indication of the crosslinking degree of the polymer. The gel content in this invention is determined as follows: a weighed polymer sample ($W_1$ g) is subjected to solvent extraction on a G-3 glass filter in a Soxhlet extractor for about 50 hours to remove the soluble portion of the polymer; the unextracted polymer is dried and weighed ($W_2$ g). The gel content is defined as $(W_2/W_1)\times100$ (%). A solvent suitable for this extraction is, for example, toluene.

The crosslinking reaction at the melt blending is a well-known thermal crosslinking reaction.

There may be mentioned as an example of crosslinking or thermal curing, crosslinking reactions of reactive resin itself like acrylic resins and polyester resins, and polymers having more than one functional group in one monomer unit, or reactions using low molecular crosslinking agents.

Preferred resins for this purpose are thermosetting acrylic resins and thermosetting polyester resins.

As suitable thermosetting acrylic resins, there may be mentioned vinyl copolymers which become reactive on heating, including copolymers of acrylic acid, methacrylic acid, hydroxyethyl methacrylate, hydroxypropyl acrylate, glycidyl methacrylate, glycidyl acrylate, or alkoxymethylolacrylamide.

Thermosetting polyester resins suitable are those prepared from dihydric or polyhydric alcohols and unsaturated or saturated dibasic carboxylic acids. The dihydric alcohols include, for example, ethylene glycol, triethylene glycol, 1,2-propylene glycol, 1,3-propylene glycol, 1,4-butanediol neopentyl glycol, 1,4-butenediol, 1,4-bis(hydroxymethyl)cyclohexane, bisphenol A, hydrogenated bisphenol A, polyoxyethylenated of bisphenol A, and polyoxypropylenated bisphenol A. The unsaturated dibasic acids include, for example, maleic acid, fumaric acid, mesaconic acid, citraconic acid, itaconic acid, and glutaconic acid. The saturated dibasic acids usable include, for example, phthalic acid, isophthalic acid, terephthalic acid, cyclohexanedicarboxylic acid, succinic acid, adipic acid, sebacic acid, and malonic acid. Polyhydric alcohols such as glycerol, trimethylolpropane, and pentaerythritol, anhydrides of the above cited dibasic acids, and polybasic acids such as trimellitic acid and pyromellitic acid may also be used as constituents of the polyester resin.

The ratio of the reactive monomers constituting the thermosetting resins is preferably in the range of from 0.1 to 30% by weight, and more preferably from 0.5 to 20% by weight.

Crosslinking agents used for crosslinking the above thermosetting resins are low molecular weight and high molecular weight compounds which have two or more reactive functional groups in each molecule; for example, the high molecular weight hardeners include epoxy resins, polyamide resins, polysulfide resins, urea-formaldehyde resins, phenol-formaldehyde resins, melamine resins, aniline resins, toluenesulfonic amide resins, isocyanate resins, alkyd resins, furfural resins, and silicone resins; and the low molecular weight crosslinking agents include ethylenediamine, diethylenetriamine, triethylenetetramine, diethylaminopropylamine, m-phenylenediamine, naphthylenediamine, menthane diamine, other polyamines, diisocyanates, succinic acid, and phthalic acid.

The amount of the hardener added may be less than ½ mole, preferably 1/5–1/30 mole, per mole of the functional group of the thermosetting resin to be hardened.

Besides the above thermosetting resin, which is the main polymer component of the toner of this invention, another polymer can be incorporated, if necessary, in the toner so far as it does not affect adversely the anti-offset property and chargeability. Polymers which may be incorporated include vinyl polymers constituted of a monomer containing no carboxyl group and polymers containing no vinyl monomer; for example, homopolymers of styrene and substituted products thereof, such as polystyrene, poly-p-chlorostyrene, and polyvinyl toluene; styrene copolymers such as styrene-p-chlorostyrene, styrene-vinyltoluene, styrene-vinylnaphthalene; styrene-acrylate, styrene-methacrylate, styrene-methyl α-chloromethacrylate, styrene-acrylonitrile, styrene-vinyl methyl ether, styrene-vinyl ethyl ether, styrene-vinyl methyl ketone, styrene-butadiene, styrene-isoprene, and styrene-acrylonitrile-indene copolymers, and other resins such as polyethylene, polypropylene, polyvinyl chloride, phenolic resins, natural resin-modified phenolic resins, natural resin-modified maleic acid resins, acrylate resins, methacrylate resins, polyvinyl acetate, silicone resins, saturated polyester resins, polyurethanes, polyamide resins, furan resins, epoxy resins, xylene resins, polyvinylbutyral, terpene resins, cumarone-indene resins, and petroleum resins.

In particular, the addition of an ethylenic olefin homopolymer or copolymer having a melt viscosity of $10–10^6$ cps at 140° C. in amounts of 0.1–10%, preferably 0.2–5%, by weight, to the toner improves the dispersibility and compatibility of colorant and magnetic fine particles in the toner and suppresses unfavorable effects of these particles on the photoconductor surface, cleaning members, and other parts of the copying machine employed. Suitable ethylenic olefin homopolymers and copolymers applied herein are, for example, polyethylene, polypropylene, ethylene-propylene copolymer, ethylene-vinyl acetate copolymer, and ethylene-ethyl acrylate copolymer. These copolymers may be constituted by preferably 50–100 mole %, and more preferably 60–100 mole %, of an olefin monomer.

The melt viscosity was measured by the Brookfield method with a B-type viscometer equipped with a small-sample adaptor.

For the toner of this invention, suitable dyes or pigments can be blended as colorants. Such dyes or pigments include well known ones, for example, carbon black, iron black, phthalocyanine blue, ultramarine blue, quinacridone, and benzidine yellow.

When a magnetic toner is prepared according to the process of this invention, a magnetic powder is mixed with other components, which can serve also as a colorant. Known magnetic materials can be used for this purpose, including ferromagnetic metals such as iron, cobalt, and nickel; alloys or compounds of these metals, such as magnetite, hematite, and ferrite; and other ferromagnetic alloys. For the purpose of controlling the chargeability and preventing agglomeration, some powder additives may also be incorporated, such as carbon black, nigrosine, metal complex salt powder, colloidal silica, and fluoro-resin powder.

The toner of this invention may be used with various development processes, for example, the magnetic brush process, cascade process, the process disclosed in U.S. Pat. No. 3,909,258 wherein a conductive magnetic toner is used, the process disclosed in Japanese Patent Laid-Open No. 53-31136 wherein a high resistivity magnetic toner is used, the process disclosed in Japanese Pat. Laid-Open Nos. 54-42141 and 55-18656, fur brush process, powder cloud process, impression process, etc.

Images developed with the toner of this invention and transferred onto a fixing member such as paper can be fixed with a hot roller the surface of which is not supplied with offset-preventing liquid, without causing the offset. The fixing roller used may be coated with a fluoro-resin such as Teflon (manufactured by Du Pont Co.), Fluon (manufactured by I.C.I. Co.), or Kel-F (manufactured by 3M Co.); or silicone rubbers or silicone resins, which form a smooth surface. A fixing roller having a metallic face may also used.

EXAMPLE 1

The following ingredients were melt-blended on a roll mill at about 130° C.:

Ratio of the ingredient to be blended:

| | | |
|---|---|---|
| (1) | Styrene-butyl acrylate-glycidyl methacrylatedivinylbenzene copolymer (monomer weight ratio = 75:20:5:0.7) (Mw/Mn = 43, gel content = 3%, melt index = 2.62.) softening point 140°C. | 100 wt. parts |
| (2) | Xylene resin modified with alkylphenol (Nikanol HP-120 supplied by Mitsubishi Gas Chemicals Co., Inc.) | 5 wt. parts |
| (3) | Magnetite powder | 60 wt. parts |
| (4) | Metal complex salt dye (Zapon Fast Black B supplied by BASP A.G.) | 2 wt. parts |
| (5) | Polypropylene wax (melt viscosity ca. 400 cps at 140° C.) | 5 wt. parts |

The resulting mixture cooled was finely pulverized in an air jet mill and classified to give a toner having particle sizes of 5–20μ. A developer was prepared by mixing 0.5 wt. part of a hydrophobic colloidal silica to 100 wt. parts of the toner, where the silica powder was attached to the outsides of toner particles.

An image forming test of this developer was conducted by using a commercial copying machine (NP-400RE of Canon K.K.). As a result, the lowest fixing temperature was 150° C. and no offset phenomenon was observed within the fixing temperature range from 150° to 200° C.

Further, a durability test of 50,000 continuous duplications was conducted on the toner at the fixing roller set temperature of 170° C. During the 50,000 duplications, the image density was kept at a nearly constant value of about 1.0. After the 50,000 duplications, there occurred none of the troubles such as the offset phenomenon on the fixing roller, adhesion of developer particles onto the photosensitive drum surface, and agglomeration of developer particles in the developing device.

COMPARATIVE EXAMPLE 1

A developer was prepared in the same manner as in Example 1 except that the xylene resin modified with an alkylphenol was not added.

Although the lowest fixing temperature of this developer was about 150° C., the same as of the developer of Example 1, the offset phenomenon became notable with increasing fixing temperature and distinct marks of transferred images were observed on the fixing roller surface at 180° C.

While a durability test was tried in the same manner as in Example 1, the offset phenomenon began at about the 500th duplication and the test was therefore stopped after 1000 duplications.

COMPARATIVE EXAMPLE 2

A developer was prepared in the same manner as in Example 1 except that the xylene resins modified with an alkylphenol was not added and the melt blending was conducted at 180° C.

The lowest fixing temperature and offset-free temperature range of this developer were the same as those of the developer of Example 1. But, as a result of the durability test, the image density was found to begin lowering at about the 10,000th duplication and reached 0.7 at the 20,000th duplication, where the test was stopped.

Further, resistance to temperature and humidity was compared between this developer and the developer of Example 1 under high temperature and humidity conditions (35° C., 85% R.H.). While the developer of Example 1 maintained the image density at 0.85 or more, this developer lowered the image density to 0.7 or less, thus being markedly inferior in humidity resistance. This seems to be attributable to a poor dispersion of the charge controlling agent metal complex salt dye.

EXAMPLE 2

The ingredients shown below were melt-blended in a midget pressure kneader at temperature up to 130° C. to prepare and evaluate a developer in the same manner as in Example 1.

Ratio of the ingredient to be blended:

| | | |
|---|---|---|
| (1) | Polyester resin having carboxyl groups (gel content 16 wt %, melt index 3.84, softening point 135° C.) | 100 wt parts |
| (2) | Epoxy resin | 6 wt parts |
| (3) | Magnetite | 60 wt parts |
| (4) | Metal complex salt dye (same as of Example 1) | 4 wt parts |
| (5) | Polyethylene wax | 4 wt parts |

The lowest fixing temperature of this developer was 150° C., no offset phonomenon occurred between 150° and 200° C. or more; and the durability was also good.

EXAMPLE 3

The monomer mixture of styrene-butyl acrylate-methacrylic acid-diallylphthalate (monomer weight ratio=75:22:3:0.4) was polymerized at 85° C. in toluene. The resulting copolymer had a Mw/Mn value of 28 and melt index of 5.34. There were melt-blended at about 140° C. with a roll mill 100 weight parts of the copolymer, 2 weight parts of diphenylmethane-4,4'-diisocyanate, 60 weight parts of magnetite, 4 parts of the metal complex dye of Example 1, and 4 weight parts of polyethylene wax to prepare a toner, and it was evaluated in the same manner as in Example 1. The fixing was done at 155° C. The offset was not observed from this temperature up to 240° C.

EXAMPLE 4

The monomer mixture of styrene-butyl acrylate-monobutyl maleate-ethylene glycol diacrylate (monomer weight ratio=75:20:5:0.2) was polymerized in toluene. The resulting polymer had a Mw/Mn ratio of 13 and a melt index of 8.74. A toner was prepared in the same manner as in Example 1 by melt blending 100 weight parts of the copolymer prepared above, 10 weight parts of an epoxy resin, 60 weight parts of magnetite, 4 weight parts of metal complex dye of Example 1, and it was evaluated. Its fixing characteristics were excellent.

EXAMPLE 5

One hundred weight parts of the copolymer used in Example 3, 6 weight parts of carbon black, 4 weight parts of metal complex dye of Example 1, and 5 weight parts of menthanediamine were melt-blended at 150° C. with a roll mill. After the blend was cooled, it was pulverized and classified to obtain the particles of the size of 5–20μ for a toner.

A developer was prepared by mixing 10 weight parts of the toner and 90 weight parts of carrier iron powder (trade name: EFV 250/400, supplied by Nippon Teppun Co.). The developer was applied to a commercial copier (trade name: NP-5000, manufactured by Canon K.K.) The fixing could be made at 150° C., and offset was not observed up to 220° C., and the durability was excellent.

We claim:

1. A process for producing a toner by melt-blending at least a colorant and a polymer and finely pulverizing the resulting blend after cooling characterized in that said polymer is a crosslinked resin having a ratio of weight-average molecular weight to number-average molecular weight (Nw/Mn) exceeding 4.0 and a melt index of 0.01–10 g/10 min. at 110° C. under a load of 10 Kg, said polymer further crosslinked during the melt-blending, and the final gel content of said polymer after the melt-blending is lower than 50%.

2. A process according to claim 1, wherein the Mw/Mn ratio of the crosslinked polymer before the melt-blending is more than 10.

3. A process according to claim 1, wherein the melt index of the crosslinked polymer before the melt-blending is 0.1–6 g/10 min. at 110° C. under a load of 10 kg.

4. A process according to claim 1, wherein the glass transition temperature of the polymer further crosslinked during the melt-blending is 50° C. or higher.

5. A process according to claim 1, wherein the weight-average molecular weight of the crosslinked polymer before melt-blending is at least 100,000.

6. A process according to claim 1, wherein the melt-blending is carried out at a temperature around the softening point of the polymer.

7. A process according to claim 1, wherein the polymer having a Mw/Mn ratio exceeding 4.0 has been prepared by a polymerization in the presence of a small amount of a polyfunctional monomer.

8. A process according to claim 1, wherein the polymer having a Mw/Mn ratio exceeding 4.0 has been prepared by a solution polymerization process.

9. A process according to claim 1, wherein the crosslinking reaction during the melt-blending is thermally initiated.

10. A process according to claim 1, wherein the polymer having a Mw/Mn ratio exceeding 4.0 is an acrylic resin.

11. A process according to claim 1, wherein the polymer having a Mw/Mn ratio exceeding 4.0 is a polyester resin.

12. A toner prepared according to the process of claim 1.

13. A toner prepared according to the process of claim 1, wherein the Mw/Mn ratio of the crosslinked polymer for the melt-blending is more than 10.

14. A toner prepared according to the process of claim 1, wherein the melt index of the crosslinked polymer before the melt-blending is 0.1–6 g/10 Min. at 110° C. under a load of 10 Kg.

15. A toner prepared according to the process of claim 1, wherein the glass transition temperature of the polymer further crosslinked during the melt-blending is 50° C. or higher.

16. A toner prepared according to the process of claim 1, wherein the weight-average molecular weight of the crosslinked polymer before melt-blending is at least 100,000.

17. A toner prepared according to the process of claim 1, wherein the melt-blending is carried out at a temperature around the softening point of the polymer.

18. A toner prepared according to the process of claim 1, wherein the polymer having a Mw/Mn ratio exceeding 4.0 has been prepared by a polymerization in the presence of a small amount of a polyfunctional monomer.

19. A toner prepared according to the process of claim 1, wherein the polymer having a Mw/Mn ratio exceeding 4.0 has been prepared by a solution polymerization process.

20. A toner prepared according to the process of claim 1, wherein the crosslinking reaction during melt-blending is thermally initiated.

21. A toner prepared according to the process of claim 1, wherein the polymer having a Mw/Mn ratio exceeding 4.0 is an acrylic resin.

22. A toner prepared according to the process of claim 1, wherein the polymer having a Mw/Mn ratio exceeding 4.0 is a polyester resin.

* * * * *

UNITED STATES PATENT AND TRADEMARK OFFICE

CERTIFICATE OF CORRECTION

PATENT NO. : 4,565,763

DATED : January 21, 1986

INVENTOR(S) : MASAKI UCHIYAMA, ET AL.

It is certified that error appears in the above-identified patent and that said Letters Patent is hereby corrected as shown below:

COLUMN 10

Line 64, "(Nw/Mn)" should read --(Mw/Mn)--.

Signed and Sealed this

Third Day of March, 1987

*Attest:*

*Attesting Officer*

DONALD J. QUIGG

*Commissioner of Patents and Trademarks*